US005183250A

United States Patent [19]

Miller et al.

[11] Patent Number: 5,183,250

[45] Date of Patent: Feb. 2, 1993

[54] MECHANISM AND METHOD FOR LATERALLY ALIGNING AN ACCUMULATION OF SHEETS

[75] Inventors: Carl A. Miller, Fairfield; Morton Silverberg, Westport; Steven A. Supron, Norwalk, all of Conn.

[73] Assignee: Pitney Bowes Inc., Stamford, Conn.

[21] Appl. No.: 491,887

[22] Filed: Mar. 12, 1990

[51] Int. Cl.[5] ..... B65H 31/34

[52] U.S. Cl. ..... 271/222; 271/223; 271/227

[58] Field of Search ..... 271/221, 222, 223, 227, 271/241, 238, 240, 253, 254, 161, 171

[56] References Cited

U.S. PATENT DOCUMENTS

| | | | |
|---|---|---|---|
| 1,935,767 | 11/1933 | DeLany | 271/222 |
| 3,172,656 | 3/1965 | Mestre | 271/222 X |
| 3,361,426 | 1/1968 | Pawlikowski | 271/240 X |
| 3,761,080 | 9/1973 | Larson | 271/222 X |
| 4,228,994 | 10/1980 | Volpe | 271/250 |
| 4,346,882 | 8/1982 | Pessing | 271/221 |
| 4,603,846 | 8/1986 | Miles | 271/221 X |
| 4,619,450 | 10/1986 | Anderson | 271/94 X |
| 4,657,239 | 4/1987 | Ikesue | 271/227 |
| 4,700,941 | 10/1987 | Shill | 271/221 X |
| 4,703,923 | 11/1987 | Anderson | 271/161 X |
| 4,874,160 | 10/1989 | Yamamoto | 271/240 X |
| 4,907,792 | 3/1990 | Washiashi et al. | 271/240 |
| 4,908,673 | 3/1990 | Muramatsu | 355/311 |
| 4,949,134 | 8/1990 | Iwaki | 271/238 X |
| 5,014,972 | 5/1991 | Anderson | 271/161 X |

FOREIGN PATENT DOCUMENTS

| | | | |
|---|---|---|---|
| 550552 | 3/1955 | Italy | 271/221 |

*Primary Examiner*—Richard A. Schacher

*Attorney, Agent, or Firm*—Robert H. Whisker; Melvin J. Scolnick

[57] ABSTRACT

An apparatus for producing items in selected configurations and a system and method for controlling the same. More particularly, an apparatus for producing mail pieces and a system and method for controlling it to produce mail pieces in a variety of configurations are disclosed. The apparatus includes a laser printer and folding sealing apparatus controlled by a data processor. The folder sealer apparatus combines sheets printed by the laser printer with pre-printed sheets and envelope forms, which also may be printed by the laser printer or may be windowed envelopes, folds the sheets as necessary and folds and seals the envelope form about the folded sheets to produce a mail piece. A user inputs a configuration for the mail piece which is translated by the data processor into a data structure and transmitted to the controller of the folder sealer apparatus. The controller controls devices comprised in the laser printer and the folder sealer by executing state routines in accordance with the data structure to produce the mail piece in the defined configuration. Concurrently the data processor transmits text from an output file to the laser printer for printing on printed sheets and envelope forms. The data processor also controls the laser printer to print an address for the mail piece either on an envelope form or on a printed sheet in a position where it will be visible through the envelope. Thus the apparatus is controlled to process an output file stored in the data processor into a mail run having a selected configuration. A mechanism and method for laterally aligning an accumulation of sheets is also disclosed, together with a cantilevered urge roller for the aligning mechanism.

5 Claims, 8 Drawing Sheets

MECHANISM AND METHOD FOR LATERALLY ALIGNING AN ACCUMULATION OF SHEETS

RELATED APPLICATIONS

The subject application is one of the following group of commonly assigned patent applications, all filed on even date herewith, all of which relate to a particular development effort conducted for the assignee of the subject application and which share common elements of disclosure.

Ser. No. 07/492,043 Envelope Form For Preparing a Multi-Sheet Mail Piece

Ser. No. 07/491,871 System and Method for Controlling an Apparatus to Produce Mail Pieces in Non-Standard Configurations Ser. No. 07/492,039 System and Method for Controlling an Apparatus to Produce Mail Pieces in Selected Configurations Ser. No. 07/493,016 System and Method for Producing Items in Selected Configurations Ser. No. 07/491,016 Mechanism and Method for Accumulating and Folding Sheets Ser. No. 07/491,875 Flap Opening Mechanism and Method Ser. No. 07/491,886 Mechanism and Method for Folding and Sealing the Upper and Side Flaps of an Envelope Form Ser. No. 07/491,887 Mechanism and Method for Laterally Aligning an Accumulation of Sheets Ser. No. 07/492,035 Sheet Feeder

BACKGROUND OF THE INVENTION

This invention relates to the production mail pieces in a variety of configurations. More particularly, it relates to a mechanism and method for laterally aligning accumulations of sheets (which may include envelope forms) prior to folding and sealing of such accumulations to form a mail piece.

Self-mailers are mail pieces which are produced from pre-cut forms which are folded and sealed to form a mail piece, and are well known, as is apparatus for printing and forming such self-mailers. Commonly assigned, co-pending U.S. application, Ser. No. 407,583, to: Samuel W. Martin, filed Sep. 14, 1989 discloses one such self-mailer wherein a pre-cut form is printed on a laser printer, or similar computer output printer, and fed to a folding and sealing apparatus to produce a self-mailer. Similarly, U.S. Pat. No. 3,995,808 to: Kehoe, issued Sep. 7, 1976 discloses another self-mailer wherein a web of forms is printed, folded longitudinally and sealed, and separated to form individual self-mailers. U.S. Pat. No. 4,063,398 to: Huffman, issued: Dec. 20, 1977 discloses another self-mailer wherein a web of forms is folded transversely to produce self-mailers. Huffman also provides for insertion of preprinted pieces or "stuffers".

In general self-mailers as taught by the prior art are useful as a means of generating large numbers of mail pieces, but are limited in that they can be formed into only a small number of configurations. (By configurations, as applied to mail pieces herein, is meant variations such as use of a windowed or a printed envelope, variations in the number and type of printed pages, and variations in the number and type of pre-printed inserts.) At most, like Huffman they may provide for an ability to insert "stuffers". Further, with the exception of the above mentioned U.S. application, Ser. No. 407,583 the equipment for producing such self-mailers has generally been physically large and suitable only for use in environments such as large computing centers.

Where it has been necessary to provide greater flexibility in the configuration of a mail piece which may be produced the solutions taught by the prior art have generally involved the use of inserters. An inserter is a transport system having a plurality of stations and along which a "control document" is transported from station to station. At selected stations pre-printed inserts maybe accumulated with the control document and at the last station the entire accumulation is inserted in a pre-formed envelope. A typical use of such inserter systems would be by a bank mailing monthly statements to its customers, where the control document would be individual statements printed on the bank mainframe computer and the inserts would include each individual's cancelled checks. Such inserter systems are described, for example, in U.S. Pat. No. 3,935,429; to: Branecky et al,; for: Process and Apparatus for Controlling Document Feeding Machines From Indicia Contained on a Document Fed Therefrom; issued Jan. 27, 1973.

Inserters do provide a high degree of flexibility in producing mail pieces in a number of configurations, and have proven very satisfactory for users such as banks and credit card companies. However, they suffer also from major limitations. First, because inserter systems generally do not operate under the control of the computer which prints the control document, a very significant problem exists in assuring that the proper inserts are matched with the correct control document. Because of this difficulty it has generally been necessary to use window envelopes with inserter systems rather than printed envelopes, so that an address pre-printed on the control document could be used to deliver the mail piece. Finally, inserters, like equipment for producing self-mailers, are generally quite physically large and suitable for use only in a large computer operation or production mail room.

Another approach to the problem of producing mail pieces was developed by Pitney Bowes Inc., assignee of the subject invention, under contract with the U.S.P.S. This equipment, known as PPHE (for Printing and Paper Handling Equipment) printed a continuous web, collated and separated the web to form sheets, folded the collated sheets longitudinally, and wrapped an envelope form around the wrapped sheets. The PPHE had a capability to add "stuffers" to a mail piece and was intended for production applications only, as the equipment was tens of feet long. The PPHE lacked capability to print envelope forms or handle variable length sheets.

A particular problem which occurs in equipment for forming mail pieces, particularly compact equipment intended for use in an office environment, is the problem of transporting and accumulating a number of sheets (possibly including an envelope form) while maintaining these sheets in lateral registration, that is with the side edges aligned so that an envelope may be readily formed around the contents. A somewhat similar problem exists with xerographic copiers where a number of original are to be copied. Typically such copiers will provide a pair of guides which may be manually adjusted to assure that the original sheets to be copies are aligned with the feed path of the copier. Such manually adjusted guides, however, are not applicable to the problem of creation of mail pieces where it is desired to accumulate sheets in a repeated and automatic fashion without operator intervention.

Thus, it is an object of the subject invention to provide a simple, automatic mechanism and method for aligning sheets as a mail piece is printed and formed.

BRIEF SUMMARY OF THE INVENTION

The above objects are achieved and the disadvantages of the prior art are overcome in accordance with the subject invention by means of an alignment mechanism and method wherein a pair of lateral guides are provided together with a guide for supporting the accumulation between the lateral guides. The subject invention further includes a drive for automatically, in response to positioning of the accumulation between the guides, moving the guides from a first position outboard of the supporting guide inwards to a second position where the lateral guides are separated by a distant substantially equal to the width of the sheets. Thus, the lateral guides laterally align the accumulation.

In accordance with one aspect of the subject invention the supporting guide is curved so that the sheets are stiffened to resist buckling under the pressure exerted by the lateral guides.

In accordance with another aspect of the subject invention the second position is selectively adjustable to comply with a plurality of widths of these sheets.

In accordance with still another aspect of the subject invention a mechanism is provided for urging the sheets into position between the lateral guides and this mechanism is disengaged from the sheets as the lateral guides are moved to align the accumulation.

In accordance with still another aspect of the subject invention a pair of guides for supporting the sheets between the lateral guides are provided.

In accordance with yet another aspect of the subject invention a cam and cam follower mechanism connected to the lateral guides is also provided for moving the lateral guides inward to laterally align the accumulation.

Thus it may be seen that the method and mechanism of the subject invention achieves the above objects and advantageously overcomes the disadvantages of the prior art. Other objects and advantageous of the subject invention will be readily apparent to those skilled in the art from consideration of the attached drawings and of the Detailed Description set forth below.

BRIEF DESCRIPTIONS OF THE DRAWINGS

DETAILED DESCRIPTION OF PREFERRED EMBODIMENTS OF THE SUBJECT INVENTION

Figure 1:
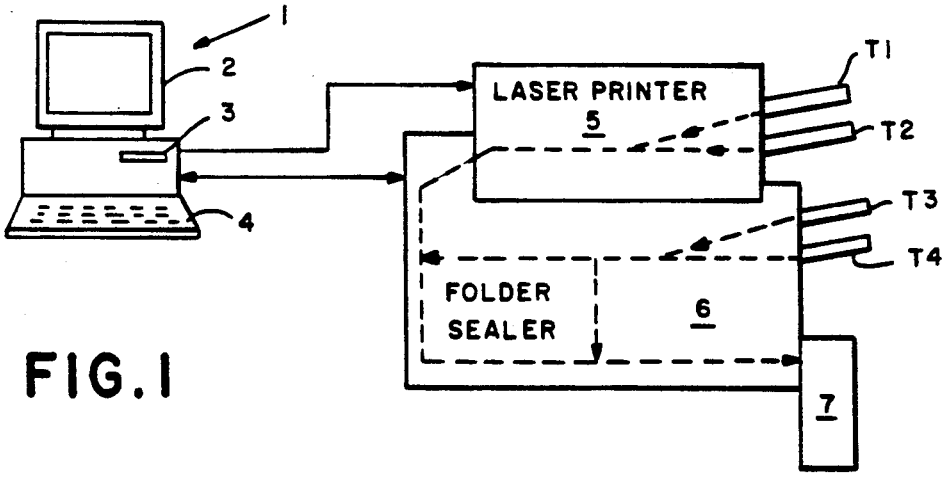
FIG. 1 shows a schematic block diagram of apparatus in which the mechanism of the subject invention may be used.

FIG. 1 shows a system for producing mail pieces and with which the alignment mechanism and method of the subject invention may be used. The system includes a personal computer 1 including a monitor 2, a hard disk 3 with at least one megabyte of available storage, and a keyboard 4. Computer 1 also requires a minimum of 640K of RAM memory in the subject invention. Optionally a computer "mouse" (not shown) may be provided for operator input. Computer 1 communicates with laser printer 5 through a conventional parallel interface which is preferably the well known Centronix interface. Preferably, Laser printer 5 is a commercially available Laser printer such as those marketed by the Hewlett Packard Corporation under the trademark "Laser Jet". Other printers, including ink jet and impact printers, may also may be used in the subject invention.

Laser printer 5 includes trays T1 and T2 from which sheets are fed to laser printer 5 for printing, as will be described further below. Tray T1 may be used for envelope forms, and tray T2 may be used for either three-thirds sheets or two-thirds sheets.

Laser printer 5 is mounted on, and physically connected to, folder sealer 6 so that, after printing, sheets are passed from laser printer 5 to folder sealer 6 where they are accumulated with an envelope form, folded and sealed, and output to stacker 7. Folder sealer 6 also includes trays T3 and T4 which may be used to add pre-printed sheets to the mail piece. Tray T3 and tray T4 may be used to supply either three-thirds, two-thirds, or one-thirds length pre-printed sheets or pre-printed business reply envelopes (BRE's) to be added to the mail pieces. Tray T3 may also be used to provide a window envelope form so that the address of the mail piece may be printed on a printed sheet rather than a separate (non-window) envelope form.

Figure 2:
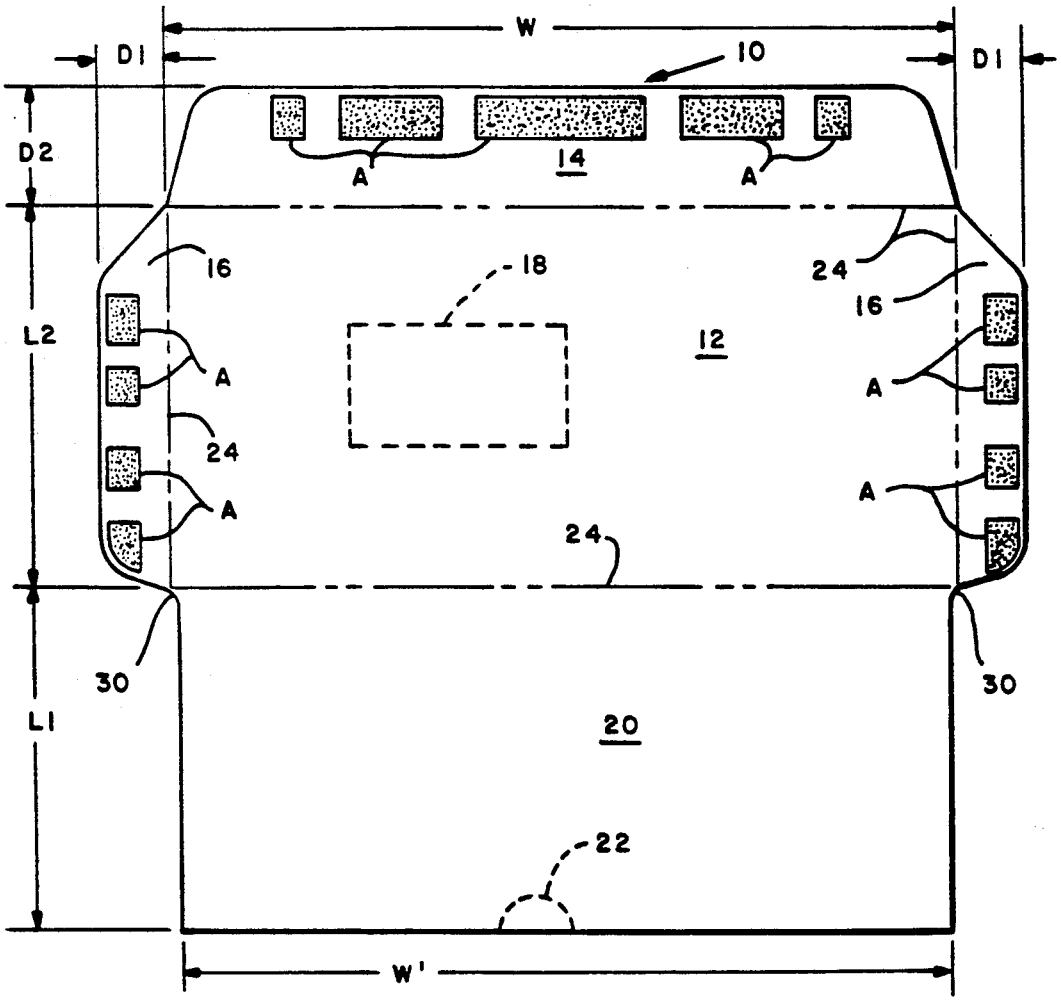
FIG. 2 shows a plan view of an envelope form suitable for use with the apparatus of FIG. 1.

FIG. 2 shows a unique envelope form, which is designed to function optimally with the apparatus of FIG. 1. Form 10 includes upper panel 12 having an upper (or trailing) flap 14 and a pair of side flaps 16. Panel 12 may also be provided with a window 18 so that the mail piece formed when form 10 is folded and sealed may be delivered to an address printed on a sheet in the mail piece. An adhesive A is applied to flaps 14 and 16 to provide for sealing of form 10 to form an envelope. Preferably adhesive A is applied to flaps 14 and 16 as spaced stripes or spots so that form 10 may be driven through the apparatus of the subject invention by segmented rollers contacting form 10 in the spaces between the stripes or spots of adhesive A so that the rollers will not be contaminated by adhesive A when it is moistened prior to sealing, and, also, to reduce curling of the form. Adhesive A is preferably a remoistenable adhesive (such as 0.0006 to 0.001 inches of dextrin/resin adhesive) which is moistened for sealing as will be described further below; but the use of self-adhesive or other suitable methods of sealing is within the contemplation of the subject invention. Flaps 14 and 16 are attached to upper portion 12, as is a rectangular lower portion 20, along preformed fold lines 24, which are preferably pre-creased to facilitate uniform folding.

To form a mail piece, sheets, which may be three thirds, two-thirds, or one-thirds sheets or BRE's, are accumulated with form 10, and form 10, together with the accumulated sheets, is folded about a fold line 24 so that the accumulated sheets are enclosed between panels 12 and 20. Adhesive A is moistened, and after folding of panels 12 and 20 and the accumulated sheets, flaps 16 are folded inwards about fold lines 24 and flap 14 is than folded downwards about fold lines 24, and the resulting mail piece is sealed.

Note that three-thirds length sheets are prefolded to two-thirds length so that the resulting mail piece is approximately one-third the length of a three-thirds sheet.

Form 10 also may be provided with expansion fold lines outboard of and parallel to allow for mail pieces having a maximum thickness; and lower panel 20 may be provided with a notch 22 to facilitate removal of the sheets when the mail piece is opened.

Form 10 is designed for optimal performance with the mechanism of the subject invention. The width W of upper panel 12 is chosen to be slightly greater than the width of the sheets to be used in the mail piece and the length L1 of lower panel 20 is chosen to be approximately equal to one-third the length of a full size sheet to be used with the mail piece. The length L2 of panel 12 is chosen to be substantially greater than length L1 to allow for increase tolerance in positioning these sheets on form 10. The width W' of lower panel 20 is equal to the width of the sheets to be used in the mail piece. By providing width W' equal to the width of the sheets, automatic centering guides may be used to center the sheets with respect to form 10 before it is folded, as will be described further below. Further, a narrower lower panel 20 allows greater skew tolerance in folding the lower panel, and aids in enveloping the contents of thicker mail pieces by permitting side flaps 16 to wrap more gradually about the mail piece.

Because lower panel 20 is substantially shorter than upper panel 12 the width D of side flaps 16 and length D2 of upper flap 14 are chosen to be sufficient to assure that the sealed mail piece completely encloses these sheets. Upper flap 14 is also formed to be substantially rectangular to assure that the envelope is closed across its full width, and lower panel 20 is provided with bevels 30 so that it flares to the full width of upper panel 12 to assure that the lower corners of the completed mail piece are closed. It should also be noted that adhesive A on side flap 16 is applied so that it extends no further than lower panel 20 when the envelope is folded and does not come into contact with the sheets within the mail piece.

For a standard $8\frac{1}{2}\times 11$ size three-thirds sheet the following approximate dimensions have been found to be satisfactory for form 10.

Figure 3:
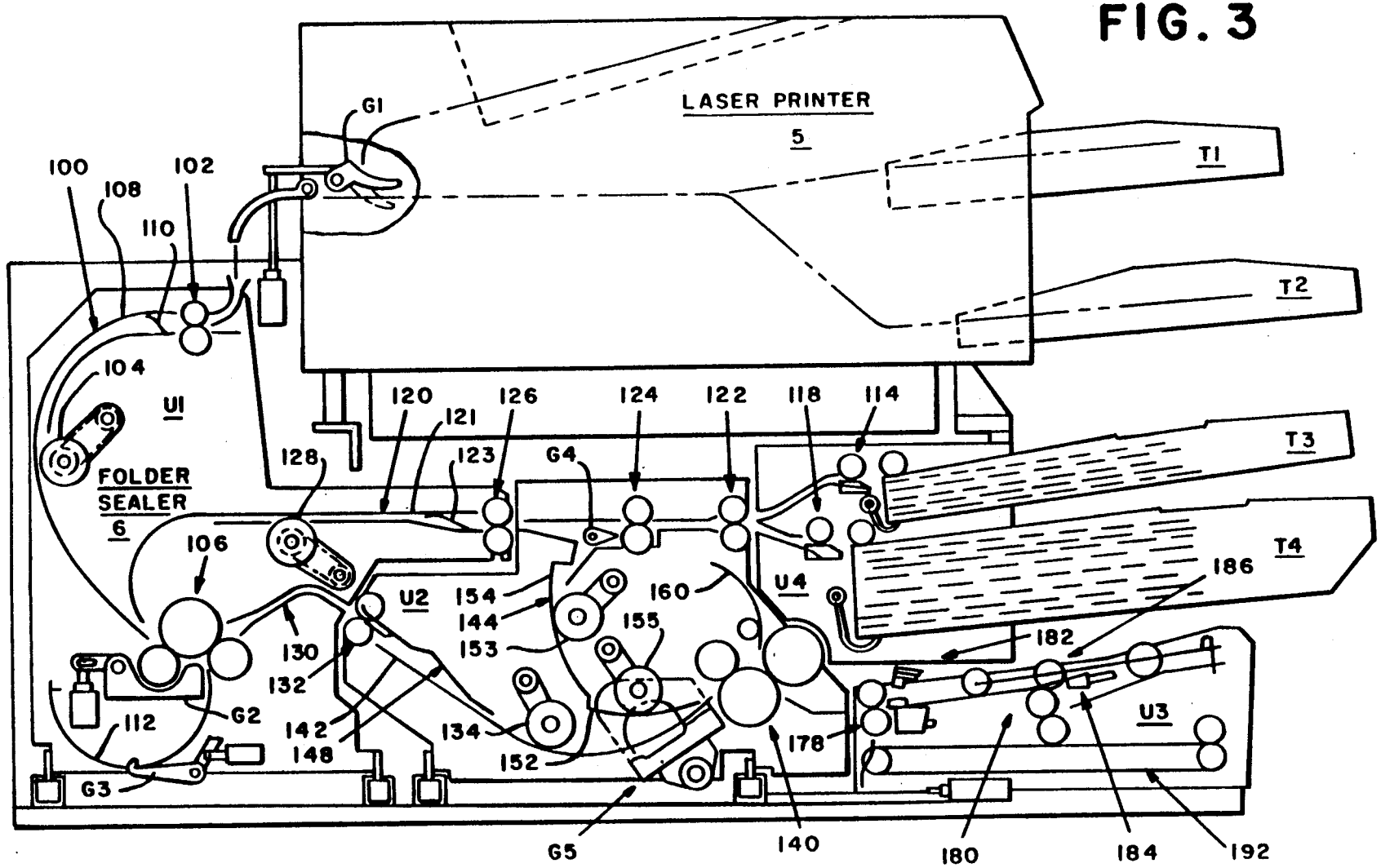
FIG. 3 shows a semi-schematic side view section of a printer and a folder sealer apparatus used in the apparatus of FIG. 1.

D1=0.75 inches
D2=1.31 inches
L1=3.75 inches
L2=4.13 inches
W=8.70 inches
W'=8.50 inches Turning now to FIG. 3 a semi-schematic side view of folder sealer 6 is shown. As a printed envelope form 10 or a printed sheet exit laser printer 5 it is driven along guides 100 by roller pair 102 and then urged into the nip of accumulator folder 106 by urge roller 104. (As used herein a sheet is "urged" when it is moved by an urge roller constructed to slip or stall on the sheet before the sheet will buckle under the load. This is in contrast with sheets which are driven by roller pairs in a positive manner, substantially without slipping.) Normally the first item will be an envelope form 10 and gate G2 will be in the activated (closed) state diverting form 10 for further processing as will be described further below. Normally following items will be printed sheets and motor Ml (shown in FIG. 6), which drives folder accumulator assembly 106 will be stopped and the sheets will be driven into the nip of assembly 106 by urge roller 104, which will continue to rotate. Because guide 100 is curved to increase the stiffness of the sheets roller 104 will slip on the sheets as they are driven into the nip of assembly 106 before the sheets will buckle. Relief 108 and spring 110 are provided in guide 100 so that the tail of any three-thirds sheet is held clear of roller pair 102 so that following printed sheets may pass over the first sheet and be accumulated in the nip of assembly 106.

If the sheets accumulated in the nip of assembly 106 include a three-thirds sheet, gate G2 is deactivated (open) and motor M1 is started and the accumulated sheets are driven into curved, open, one sided buckle chute 112. Such chutes are described in U.S. Pat. No. 4,834,699 to: Martin; the disclosure of which is hereby incorporated by reference. The assembled sheets are folded by assembly 106 to a two-thirds length and exit assembly 106 for further accumulation with the previously passed form 10. Gate G3 may be activated for a "Z" fold (normally used with a window envelope); as will be described further below.

If the sheets to be folded have significant curl it may prove necessary or desirable to use conventional closed buckle chutes or to provide some other means of controlling the folding of curled sheets predisposed to fold in the wrong direction.

Alternatively a window envelope or pre-printed sheets, of three-thirds length, may be fed from trays T3 or T4 by feeder assemblies 114 or 118 and, with gate G4 deactivated, driven along curved guides 120 by roller pairs 122, 124, and 126 and urged by urge roller 128 for processing by accumulator folder assembly 106 in the same manner as described above for printed envelope forms 10 and printed sheets. Relief 121 and spring 123 are provided to assure that following sheets pass over previous sheets for accumulation.

If the sheets accumulated in the nip of assembly 106 are all two-thirds length the assembled sheets exit assembly 106 along guide 130 without folding.

The previously processed form 10, followed by the accumulated sheets, is moved along guides 130 by roller pair 132 and urge roller 134 until it is urged into the nip of accumulator folder assembly 140. Motor M2 (shown in FIG. 6), which drives assembly 140 is off and the leading edge of the accumulated sheets is aligned with the edge of lower panel 20 of form 10 in the nip of assembly 140. In the same manner as previously described guides 130 are curved to increase the stiffness of form 10 and the accumulated sheets. Relief 142 operates as described above so that the accumulated sheets will clear form 10 and progress to the nip of assembly 140.

Since laser printer 5 will normally have a feed path designed for a conventional paper size (e.g. approximately 8 $\frac{1}{2}$") envelope form 10, when fed through printer 5 is fed with flaps 16 folded into the closed position. Accordingly, opening mechanism 148 is provided along path 130 to open flaps 16 before form 10 is accumulated with the following sheets.

Lateral guides G5 are provided to assure that the sheets are centered with panel 20 of form 10.

If two-thirds sheets, one-third sheets, or BRE's are fed from trays T3 or T4 along guides 120 gate G4 is activated and these sheets are diverted to guides 144. The diverted sheets are urged by urge rollers 146 and 148 into the nip of assembly 140 and are accumulated in the manner described above in the nip of assembly 140 with the previously processed envelope form 10, and any pre-formed printed or pre-printed three-thirds sheets. Guides 144 include relief 152 for one-thirds pre-printed sheets and BRE's and relief 154 for two-thirds pre-printed sheets.

After all sheets are accumulated with form 10, motor M2, which drives accumulator folder assembly 140 is started and drives the completed accumulation into buckle chute 160 so that the completed accumulation is folded about fold line 24 between upper panel 12 and lower panel 20 of form 10. As the folded accumulation exits from assembly 140 it is captured by roller pair 178 and carried into flap folder sealer assembly 180. There adhesive A is moistened by moistener 182, side flaps 16 are closed by closing mechanism 184 and tailing flap 14 is closed, and all flaps are sealed by roller assembly 186. At this point form 10 and the accumulated sheets have been formed into a sealed mail piece. The sealed mail piece than is transported by transport 192 and exits folder sealer 6.

As sheets are driven into the nips of assemblies 106 and 140 with motors M1 and M2 not operating, any slight skew of the sheets with respect to the path of travel will be corrected as the leading edge of the sheets (or envelope form) are driven into the stationary nip. However, if the skew of the sheets is too great the leading corner may bind in the nip preventing correction of the skew. To avoid this it may prove desirable to briefly operate motors M1 and M2 in a reverse direction to allow the leading edges of the sheets to align themselves parallel to the nips as they are driven against them.

As will be described below appropriate velocity profiles for motors M1 and M2 are readily achieved since motors M1 and M2 are stepper motors having readily controllable velocity profiles. (While stepper motors have proven adequate other types of motor, such as conventional brushless d.c. gear motors, which have better low speed torque characteristics, are within the contemplation of the subject invention and may prove preferable.)

Figure 4:
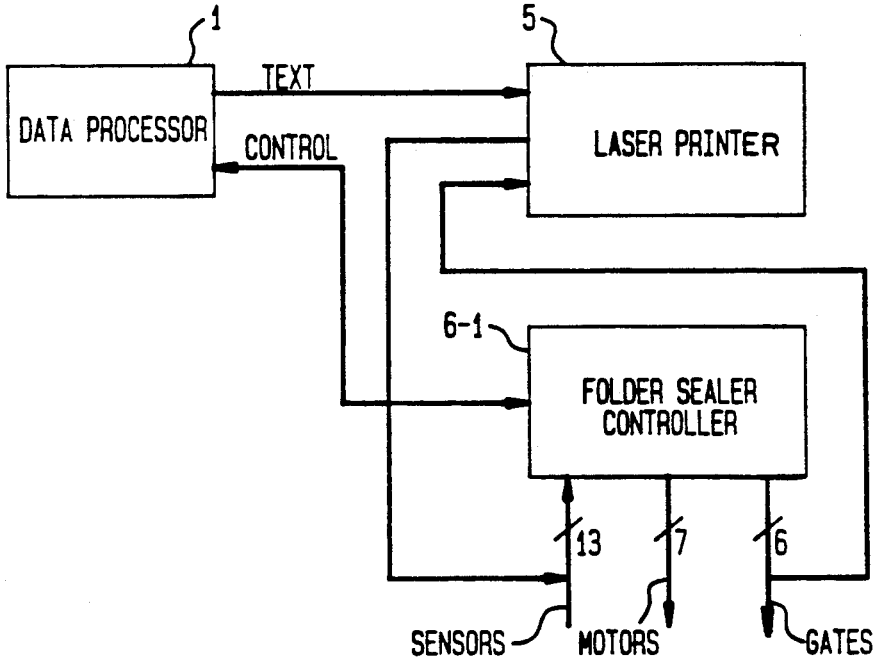
FIG. 4 shows a schematic block diagram of the flow of control and text information signals in the apparatus of FIG. 1.

Turning to FIG. 4 the control architecture for the system of the subject invention is shown. As described above data processor 1 controls laser printer 5 through a parallel interface in a conventional manner to print text. Folder sealer 6 is controlled through a conventional serial communications port, such as an RS232 port. Folder sealer 6 is controlled by controller 6-1, which includes an integrated circuit microcontroller, which is preferably a model 80C196KB manufactured by the Intel Corporation of California. As will be described below controller 6-1 receives data structures defining the configuration for mail pieces in a given mail run from data processor 1, as well as specific information for each mail piece, such as ID numbers and variable numbers of printed sheets to be included in the mail piece. Controller 6-1 than controls devices, (i.e. sensors, motors, and gates) in folder sealer 6 to produce mail pieces in accordance with the data structures and specific mail piece information. As can be seen in FIG. 4, minor modifications, easily within the skill in the art have been made to laser printer 5 to allow controller 6-1 to read sensors S1, S2 and S3 provided in laser printer 5 and control gate G1 which is also part of laser printer 5.

Figure 5:
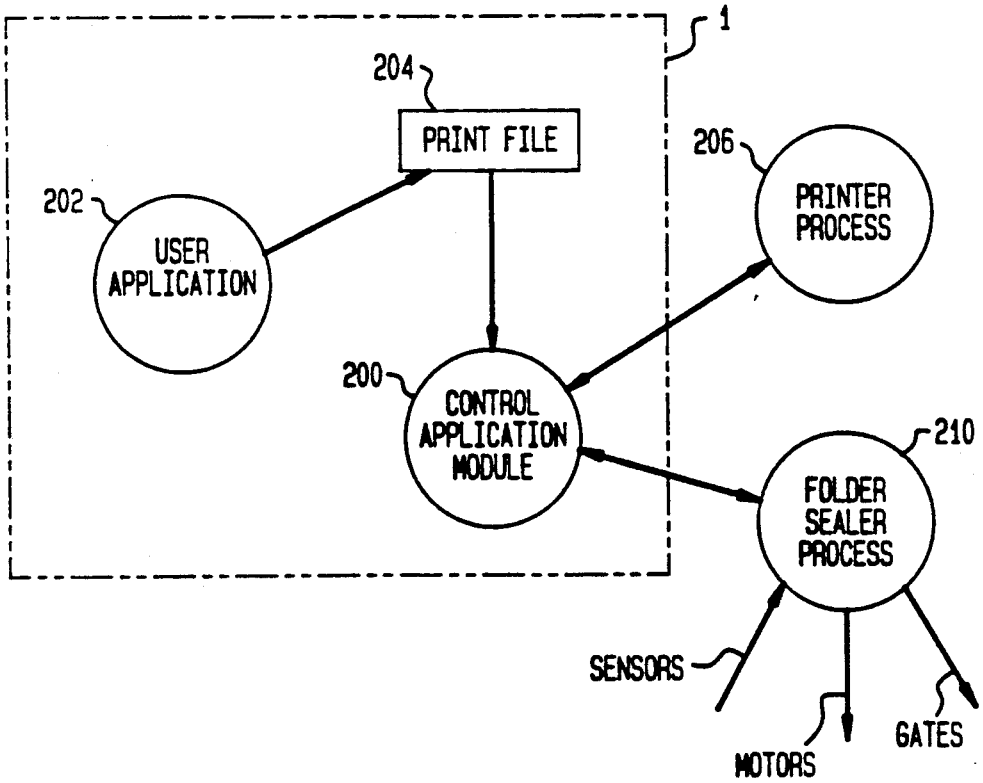
FIG. 5 shows a data flow diagram for the apparatus of FIG. 1.

FIG. 5 shows the software architecture for the subject invention. In accordance with the subject invention data processor 1 runs a Control Application Module 200 to process documents produced by a conventional user application program 202 and output to a conventional print file 204. Control Application Module 200 includes a conventional printer driver to communicate with Printer Process 206 to print text from the documents in file 204 in a known, conventional manner, and a conventional, serial communications driver to communicate with folder sealer process 210, which runs in folder sealer controller 6-1. Module 200 also includes a Control Application Program which enables a user to define the mail piece configuration for a particular mail run. Data structures defining this configuration, as well as specific mail piece information are communicated to process 210 by the Communication Driver, and process 210 controls motors and gates in response to sensors to produce mail pieces comprising documents produced by the user application 202 and having a configuration in accordance with the data structures and specific mail piece information; as will be described further below.

Figure 6:
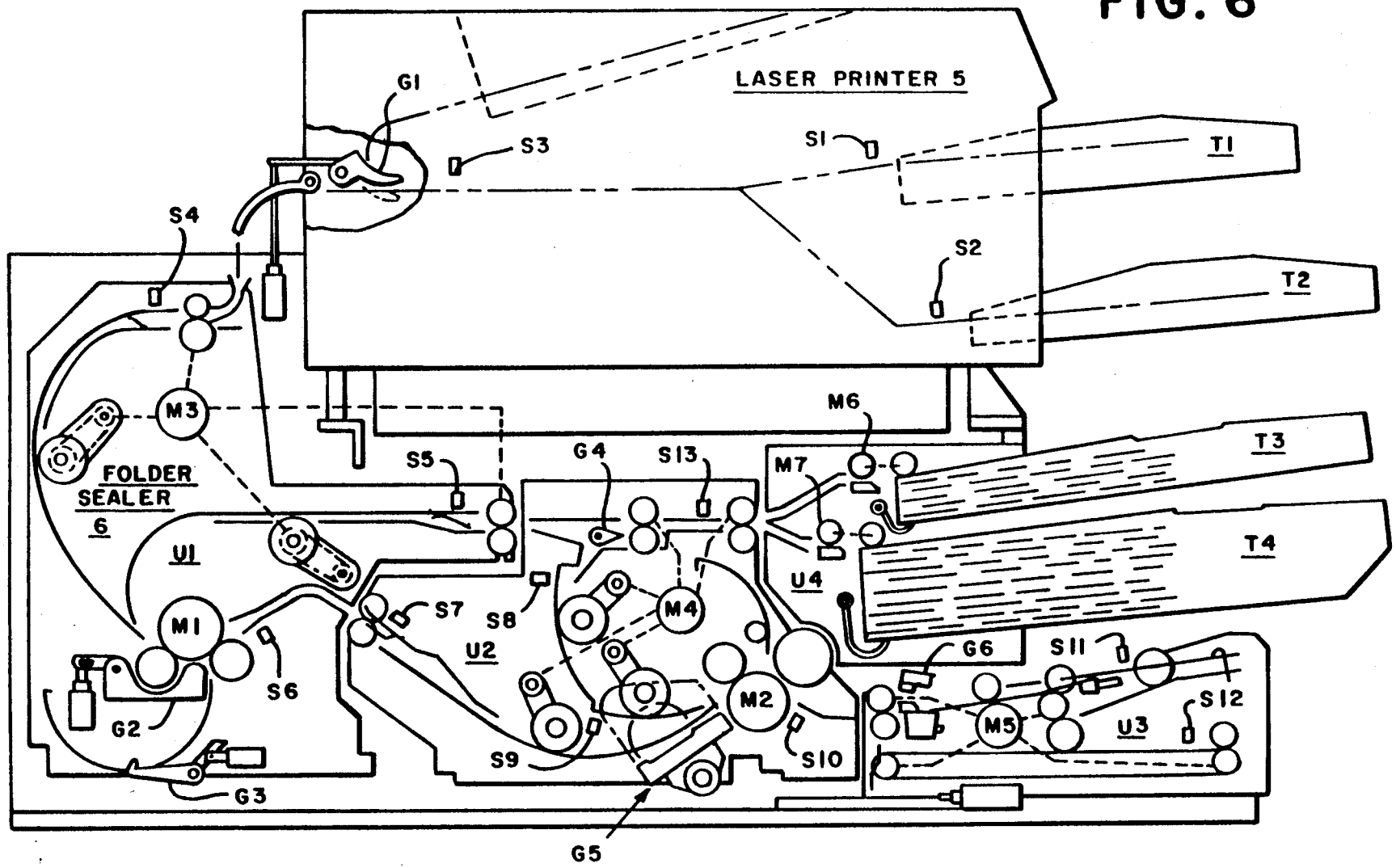
FIG. 6 shows the view of FIG. 3 showing the relationships of sensors, gates, and motors.

FIG. 6 is a schematic diagram of the sensors, motors and gates used in the prefer embodiment of the subject invention shown in FIG. 3. Sensors S1, S2 and S3 are part of commercially available laser printer 5. In the embodiment shown sensors S1 and S2 are provided by monitoring the feed signals to trays T1 and T2, though optical sensors to positively detect passage of sheets are, of course, within the contemplation of the subject invention. Sensor S3 is an optical sensor also provided in laser printer 5 which monitors output of sheets after printing. Gate G1 is a mechanical gate, also part of laser printer 5, which diverts sheets for output on top of laser printer 5, and as noted, has been modified so that it operates under control of controller 6-1. Sensor S4 is an optical sensor provided in folder sealer 5 to detect passage of a printed sheet from laser printer 5 to folder sealer 6 along guides 100. Sensor S5 is an optical sensor which detects the presence of pre-printed sheets on guides 120 downstream of gate G4. Sensor S6 detects the presence of sheets output from accumulator folder assembly 106 on guides 130, and sensor S7 detects the presence of sheets accumulated in the nip of accumulator folder assembly 140. Sensors S8 and S9 detect the presence of two-thirds and one-thirds sheets, respectively, which have been diverted from guide 120 by gate G4 to accumulator folder assembly 140. Sensor S10 is an optical sensor which detects the presence of a folded envelope form 10 and accumulated sheets output from apparatus 140 and sensor S11 is an optical sensor which detects the presence form 10 and the accumulated sheets in trailing flap folder sealer 180. Sensor S12 is an optical sensor which detects the output of a folded and sealed mail piece. Sensor S13 is an optical sensor which detects the presence of pre-printed sheets on guides 120 upstream from gate G4.

Gate G1 diverts sheets after printing for output at the top of laser printer 5 so that laser printer 5 may be used as a conventional computer output line printer without printed sheets passing through folder sealer 6, and also to facilitate recovery from jam conditions. When activated gate G2 diverts envelope form 10 and two-thirds length printed sheets through assembly 106 without folding. When activated gate G3 effectively shortens the length of buckle chute 112 so that accumulated for folding by assembly 106 are ultimately folded in a "Z" fold, and when deactivated allows the full length of the accumulated sheets into buckle chute 112 so that these sheets are ultimately folded in a "C" fold. Gate G4 when activated diverts pre-printed two-thirds and one-thirds length sheets and BRE's from guide 120 to guide 144 for accumulation at accumulator folder assembly 140.

As will be described further below gates G5 and G6 are different from the other gates in that they do not change the path followed by sheets as they move through folder sealer 6. However, for control purposes they are handled as gates. Gate G5 is actually a pair of symmetrically movable lateral guides which are operated to assure that sheets accumulated with form 10 and apparatus 140 are laterally aligned with form 10. Gate G6 is a moistening apparatus which moistens adhesive A on form 10 as it enters trailing flap folder sealer 180. Gates G1–G6 are each operated individually under direct control of controller 6-1.

Motors M1 and M2 operate accumulator folder assemblies 106 and 140 respectively. Motor M3 operates urge rollers 104 and 128, and roller pairs 102 and 126, and motor M4 operates urge rollers 146 and 148 and roller pairs 122, 124, and 132 (all shown in FIG. 3).

Motor M5 operates flap folder sealer 180 and motors M6 and M7 feed pre-printed sheets from trays T3 and T4, respectively. Motors M1 through M7 are each operated individually under the direct control of controller 6-1.

Figure 7:
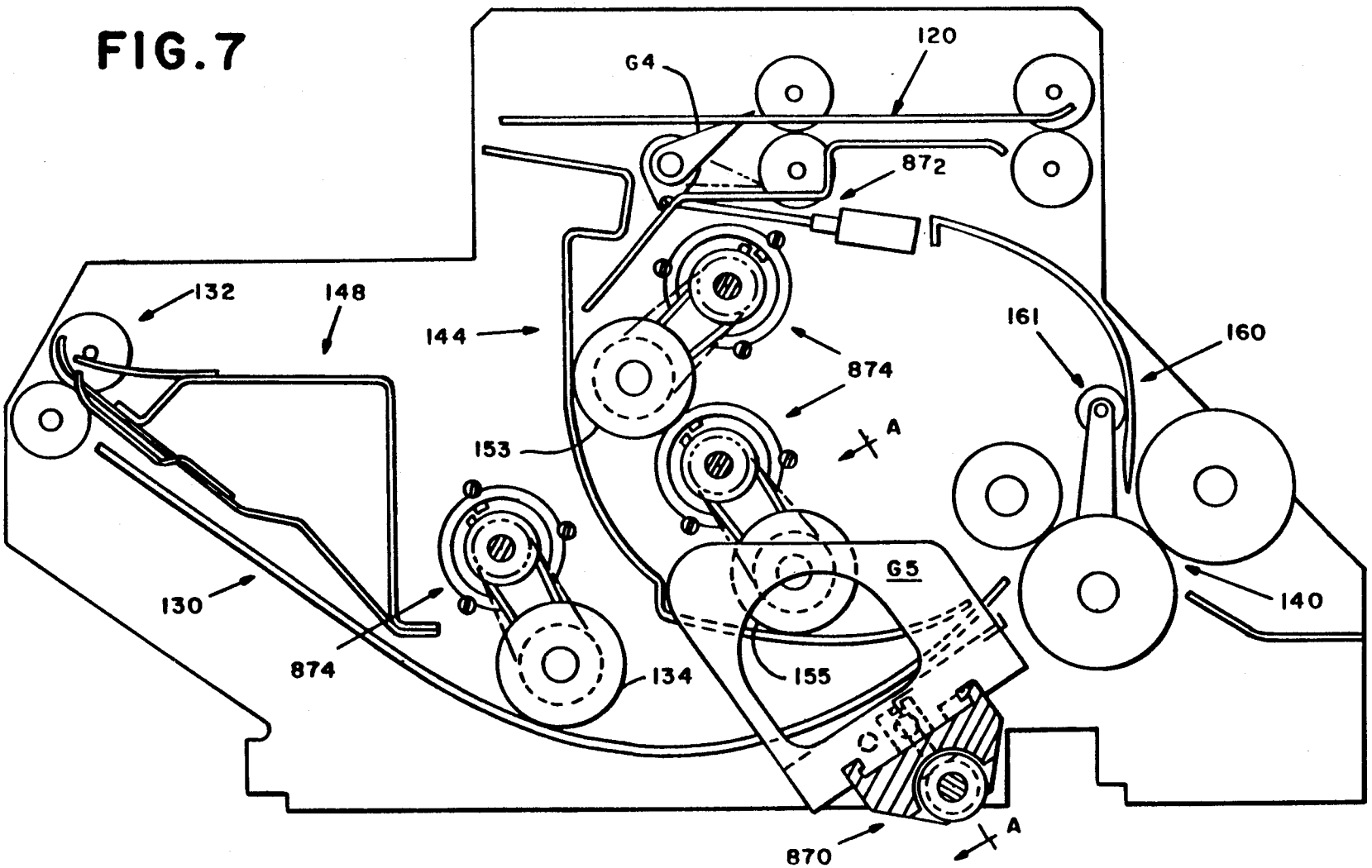
FIG. 7 shows a side view of a mechanism for forming an accumulation of sheets with an envelope form.

FIG. 7 shows a side view of the mechanism for forming the final accumulation of printed and/or pre-printed sheets with envelope form 10 to assemble all elements of the mail piece. Form 10 is captured by roller pair 132 and, if necessary, flaps 16 are unfolded by mechanism 148 and form 10 is urged into the nip of accumulator folder assembly 140 by urge roller 134. Fcrm 10 may than be followed by an accumulation of sheets, which, if the accumulation includes three-thirds length sheets, has been folded to two-thirds length by accumulator folder 106, which accumulation is also urged into the nip of accumulator folder assembly 140 to form the final accumulation.

Accumulator folder assembly 140 operates in a substantially identical matter to accumulator folder assembly 106. Once the final accumulation is formed motor M2 is energized to urge the accumulation into buckle chute 160 which is designed to fold the accumulation in half; that is from two-thirds to one-thirds length, and the final accumulation exits for folding and sealing of flaps 16 and 14.

Because buckle chute 160 is oriented substantially vertically idler assembly 161 and support springs (not shown) are provided to conform the final accumulation to chute 160 during folding.

To assure that form 10 and the accumulated sheets are laterally aligned lateral guides G5 are provided. These guides are symmetrically positioned outboard of guides 130 and 144, and, as the final accumulation is formed, are cycled inwards, in a symmetrical manner until they are separated by the predetermined width of the sheets used; typically 8½". This aligns the sheets and form 10 and guides G5 are returned to their initial position where they will not interfere with further processing. The curvature of guides 130 facilitates the alignment process by stiffening the sheets against the pressure exerted by lateral guides G5 so that the sheets slide laterally into alignment without buckling.

Preprinted sheets may be diverted from guides 120 by gates G4 when it is activated by solenoid assembly 872. These pre-printed sheets, which may be one-thirds or two-thirds in length are urged along guides 144 by urge rollers 154 and 152 into the nip of accumulator folder assembly 140 to form part of the final accumulation. Note that these pre-print sheets are also laterally aligned by lateral guides G5 when it is operated.

For lateral guides G5 to be effective urge rollers 130, 153, and 155, which may be in contact with form 10 and/or various sheets, must be disengaged when guides G5 are activated. To achieve this rollers 134, 153, 155, are mounted on identical pivoting cantilevered assemblies 874, which assemblies both allow the rollers to be pivoted away when guides G5 are activated and allow the normal pressure with which the rollers bear to be adjusted, as will be described further below.

Preferably lateral guides G5 are cycled once each time a sheet (or accumulation of sheets) is urged into the nip of assembly 140. This assures that, when urge rollers 134, 153 and 155 are reengaged, each sheet will again be urged into the nip of course if sheets are accumulated on both guides 130 and 144 such sheets may be simultaneously aligned by one cycle of gate G5.

Figure 8:
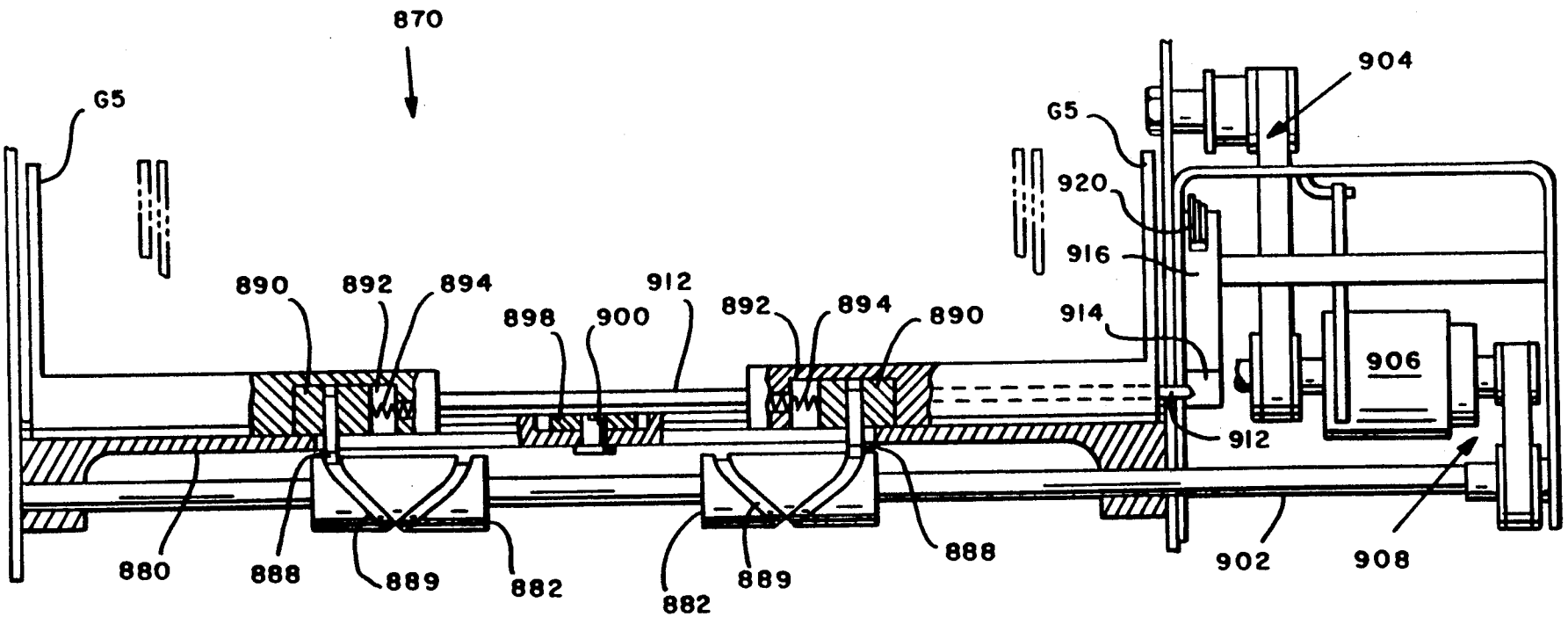
FIG. 8 shows a cross section view along lines A—A in FIG. 7, and partially broken away, of a mechanism for operating lateral guides used in an embodiment of the subject invention.

FIG. 8 shows a cross section view of mechanism 870 which operates guides G5. Guides G5 are supported and laterally guided by support structure 880, which is preferably formed of a low friction material such as nylon or teflon. Guides G5 are cycled inwards, in a symmetrical manner by helical cams 882. Cam follower 888 is mounted in block 890, which in turn is biased within cavity 892 by springs 894. As cams 882 make two complete rotations cam follower 888 will follow double helix groves 889 in cams 882 causing guides G5 to cycle inwards to pre-determined positions (shown in phantom in FIG. 8) and return to their starting position).

As shown in FIG. 8 mechanism 870 is adjustable for two standard paper sizes, typically 8½" and A4 size metric size paper. This is achieved by rotating rectangular central stop 898 to provide either a shorter path of travel for guides G5 (for wider 8½" paper), or by rotating rectangular stop 898 around pivot mount 900, providing a longer path of travel for guides G5 (for narrower A4 paper). When stop 898 is adjusted for 8½" sheets guides G5 are stopped by stop 898 before cam 882 has completed a full rotation. As cam 882 completes the rotation spring 894 is compressed within cavity 892 allowing block 890 to move within guide G5 and follower 888 to continue to follow grove 889. When stop 898 is adjusted for A4 size paper blocks 890 remain biased against the outside walls of cavities 892 throughout the full cycle of cams 882.

Cams 882 are mounted on and driven by shaft 902 by motor M4 through belt 904, one cycle clutch 906, and 1:2 belt and pulley assembly 908. As the sheets and envelope form 10 are formed into the final accumulation at the nip of assembly 140 motor M4 is energized and clutch 906 is activated by controller 6-1. Thus, clutch 906 outputs a single revolution which, through 1:2 belt and pulley assembly 908, causes shaft 902 and cams 882 to complete two revolutions; cycling guides G5.

In order to disengage rollers 134, 152 and 154 rod 912 is fixed to the left, or outboard, one of guides G5 and extends inboard to bear against angled surface 914 of lever 916. As lateral guides G5 move inward rod 912 is advanced and angled surface 914 causes lever 916 to be displaced as shown in phantom in FIG. 20.

Figure 9:
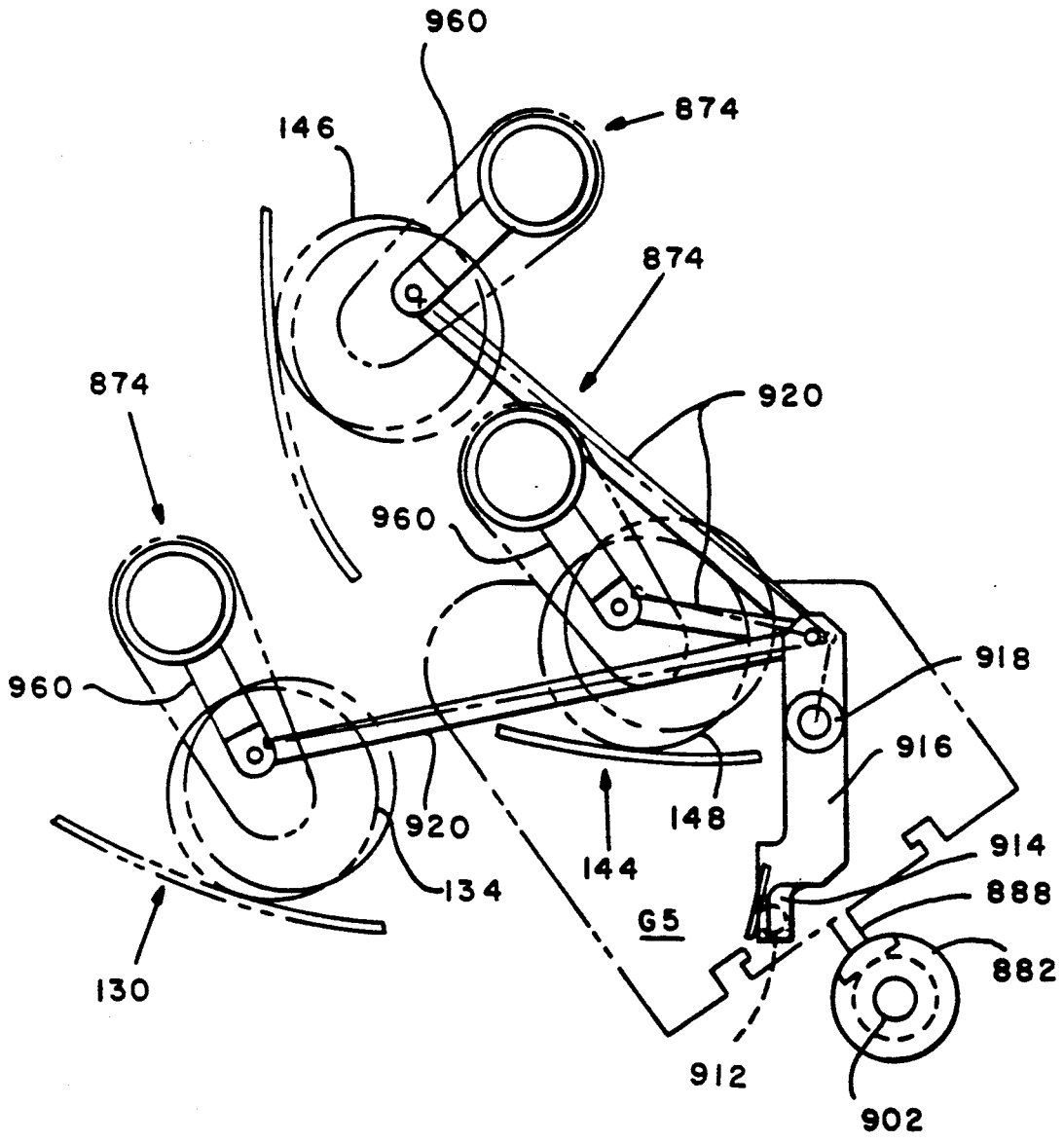
FIG. 9 shows a semi-schematic side view of a mechanism for displacing urge rollers used in the mechanism of FIG. 7.

As it seen in FIG. 9 lever 916 rotates about pivot 918 as it is displaced and is connected by links 920 to cantilever mounts 872. As will be described below, the action of lever 916 and links 920 is coupled through mounts 872 to displace urge rollers 134, 152 and 154 as shown in phantom in FIG. 9.

Figure 10:
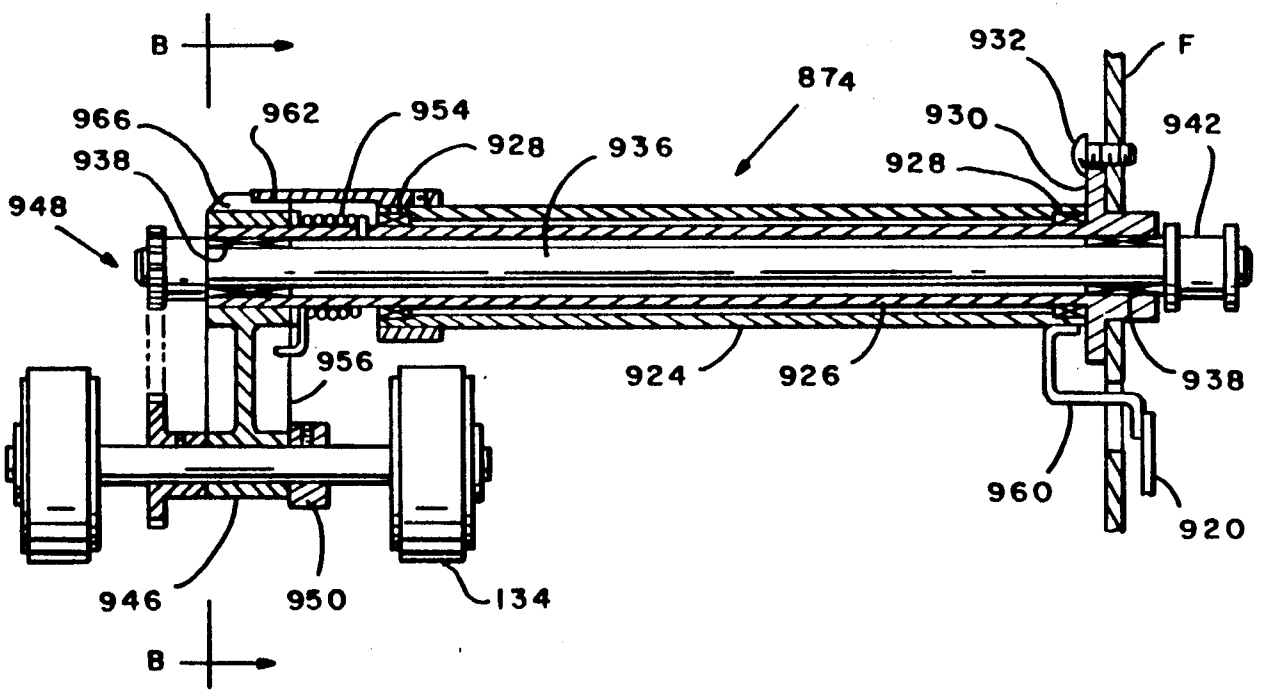
FIG. 10 shows a cross-section view of a cantilever support for an urge roller, taken along lines A—A of FIG. 11.
Figure 11:
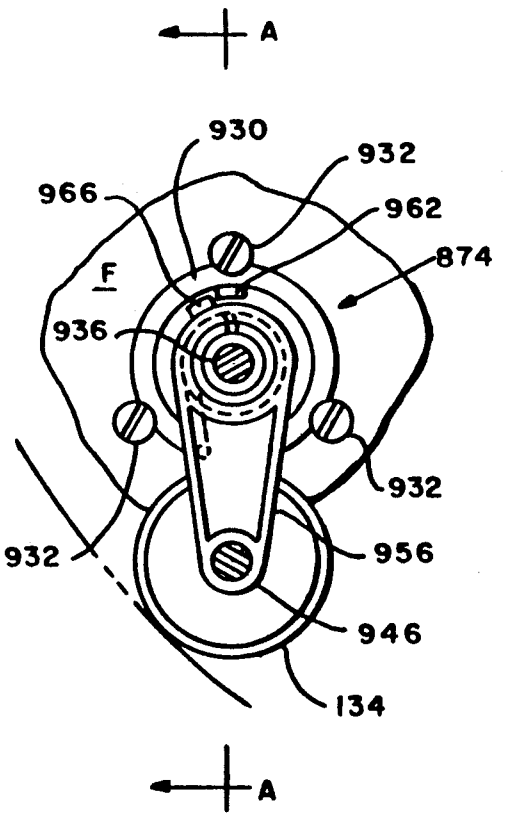
FIG. 11 is a sectional end view taken along lines B—B of FIG. 10.

Turning to FIGS. 10 and 11. Cantilever support mechanism 874 is shown. Support mechanism 874 includes an outer tube 924 which is coaxial with and rotatable around inner tube 926 on bearings 928. Inner tube 926 includes a collar 930 which is secured against frame F of folder sealer 6 by screws 932 so as to hold inner tube 926 fixed. Shaft 936 is mounted within and is coaxial with inner tube 926 and rotates on bearings 938. Pulley 942 is fixed to the inboard end of shaft 936 which projects through and inboard of frame F. Pulley 942 is connected by a belt (not shown) to motor M4.

At the outboard end of inner tube 926 arm 946 is mounted to be free for rotation. Preferably arm 946 is formed from a low friction material such as nylon or teflon so as to allow free rotation. At the distal end arm 946 supports an urge roller (shown here as urge roller 134). Belt and pulley assembly 948 is fixed to shaft 936 and urge roller 134 to transmit the rotation of shaft 936 to roller 134. Collar 950 is also provided to secure urge roller 134 to arm 946.

Torsion spring 954 bears against surface 956 of arm 946 at one end, and at the other end is fixed to inner tube 936.

By adjusting the tension in spring 954 the force in with which roller 134 bears against envelope form 10 or printed or pre-printed sheets may be adjusted. This tension may be adjusted by loosening screws 932 and rotating inner tube 936 to wind spring 954 and increase the force or unwind spring 954 and decrease the force.

When lateral guides G5 are activated the motion of lever 916 is transmitted by link 920 to crank arm 960, as can be seen in FIG. 9. Crank arm 960 in turn causes outer tube 924 to rotate in a counter clockwise direction with respect to an observer looking inboard. Extended element 962 is fixed to the outboard end of outer tube 926 and bears against surface 966 of arm 946, coupling the rotation of outer tube 926 to urge roller 134 and causing it to rotate to a disengaged position, shown in phantom in FIG. 9.

In accordance with the subject invention the coefficient of friction of roller 134 (and other urge rollers) and the force with which the urge rollers bear against form 10 or the printed or pre-printed sheets is chosen so that urge rollers will provide a limited amount of force to urge accumulations into the nip of accumulator folder assemblies 140 and 106 without buckling and will then slip on the paper surface. This force may be determined by selecting an appropriate surface material for rollers 104, 134, 152, and 154, and adjusting the bearing force of these rollers as described above.

Note that urge roller 104 associated with accumulator folder assembly 106 is mounted similarly except that no provision is necessary to disengage roller 104.

EXAMPLE

A prototype system, substantially as shown in FIG. 3 and including a mechanism in accordance with the subject invention has been developed and tested and is believed to have satisfactorily achieved the objects of the subject invention. The following parameters have been found acceptable in the prototype system.

A sheet and form are input from laser printers at a velocity of approximately 2 inches per second along guide 100.

The final accumulation of form 10 with printed and pre-printed sheets is transported through flap folder sealer 180 at a velocity of approximately 3 inches per second.

Accumulator folder assemblies 106 and 140 and all other urge rollers and roller pairs transport sheets and/or form 10 at 8 inches per second.

An input velocity of two inches per second matches the output laser printer 5, while the increase in velocity to eights inches per second of accumulator sheets with form 10, laterally align the final accumulation and fold it to one-third size (i.e. letter size). It is believed that the system speed can be increased to match higher speed printers with little effort.

The urge rollers apply a normal force in the range of two to five ounces. Lower levels of force are chosen where the sheet is urged over a longer distance, as the columnar stiffness of the sheet decreases with the length over which the load is applied.

The bearing surfaces of the urge rollers are micro-cellular urenthane and have a coefficient of friction of from 1.0 to 1.4.

Buckle chutes, and the portions of guides supporting sheets in the nips of assemblies 106 and 140, have radii of curvature (not necessarily constant) of from 2 to 5 inches.

The above descriptions and examples have been provided by way of illustrations only, and those skilled in the art will recognize numerous embodiments of the subject invention from the Detailed Description and attached drawings. Particularly, those skilled in the art will recognize that there is, in principle, no reason why sheets of other fractional lengths less than 3/3's (such as ½ or ⅞'s) cannot be processed by the subject invention; though some otherwise possible accumulations may tend to jam when such sheets are included. Accordingly, limitations on the scope of the subject invention are to be found only in the claims set for below.

What is claimed is:

1. An alignment mechanism for simultaneously aligning a plurality of sheets in an accumulation of sheets, comprising:

a) a pair of lateral guides;

b) a guide for supporting said accumulation between said lateral guides;

c) a cam and cam follower mechanism connected to said lateral guides for moving said lateral guides inwards to laterally align said accumulation in a single operation; wherein, d) said cam follower mechanism includes a resilient coupling and said alignment mechanism includes an adjustable stop for limiting the travel of said lateral guides, whereby the movement of said lateral guides may be adjusted to accommodate a plurality of widths of said sheets.

2. An alignment mechanism as described in claim 1 wherein said supporting guide is curved, whereby said sheets are stiffened to resist buckling as they are aligned by said lateral guides.

3. An alignment mechanism as described in claim 2 further comprising:

a) means for moving said accumulation into a position between said lateral guides; and, b) means for disengaging said moving means from said accumulation as said accumulation is laterally aligned.

4. An alignment mechanism as described in claim 1 further comprising:

a) means for moving said accumulation into position between said lateral guides; and, b) means for disengaging said moving means from said accumulation as said accumulation is laterally aligned.

5. An alignment mechanism for simultaneously laterally aligning a plurality of sheets in an accumulation of sheets of paper for incorporation in a mail piece, comprising:

a) a guide for supporting said accumulation;

b) a pair of lateral guides having a first position outboard of said accumulation;

c) means for automatically moving said guides linearly from said first position to a second position in response to positioning of said accumulation between said guides, said guides being separated in said second position by a distance substantially equal to the width of said sheets, whereby said accumulation is laterally aligned by the movement of said guides in a single operation.

* * * * *